United States Patent [19]

Boie et al.

[11] Patent Number: 4,532,201

[45] Date of Patent: Jul. 30, 1985

[54] PROCESS AND AN APPARATUS FOR THE DEVELOPMENT OF PHOTOGRAPHIC TWO-SHEET DIFFUSION MATERIALS

[75] Inventors: Immo Boie, Niederkassel; Guido Kovacic, Unkel, both of Fed. Rep. of Germany

[73] Assignee: Agfa-Gevaert Aktiengesellschaft, Leverkusen, Fed. Rep. of Germany

[21] Appl. No.: 603,074

[22] Filed: Apr. 23, 1984

[30] Foreign Application Priority Data

May 4, 1983 [DE] Fed. Rep. of Germany ..... 3316267

[51] Int. Cl.[3] ..... G03C 5/54

[52] U.S. Cl. ..... 430/202; 430/207; 430/403; 354/302

[58] Field of Search ..... 430/202, 207, 403; 354/302

[56] References Cited

U.S. PATENT DOCUMENTS 4,223,991 9/1980 Brenner ..... 354/302

FOREIGN PATENT DOCUMENTS 375609 2/1964 Switzerland ..... 354/302

*Primary Examiner*—Richard L. Schilling

*Attorney, Agent, or Firm*—Connolly & Hutz

[57] ABSTRACT

An imagewise exposed negative sheet (1) and a positive sheet (2) of a two-sheet diffusion material which are joined together by an adhesion strip (3), transversely to the direction of movement of the sheets (1,2), are passed for wetting in tandem through a developing liquid (6). Thereafter, the rigidity of the sheets (1,2) and the flexibility of the adhesive strip (3) are used, together with a collecting device (11) and a stop (12) for the first-wetted sheet (2) which is adjustable therein to cause an independent V-shaped folding together of the sheets (1,2) about the adhesive strip bending point (14). A deflecting device (9) is adjusted so that the V-shaped folded bending point (14) is guided into the gap between a pair of pressing rollers (10), by which it is taken up. The sheets (1,2) are pressed together and are discharged, in this condition, into a collecting tray (15) through a discharge channel (13).

2 Claims, 6 Drawing Figures

PROCESS AND AN APPARATUS FOR THE DEVELOPMENT OF PHOTOGRAPHIC TWO-SHEET DIFFUSION MATERIALS

This invention relates to a process and an apparatus for the development of photographic two-sheet diffusion materials, in which process and apparatus a positive sheet and an exposed negative sheet attached to the positive sheet, are guided through a developing liquid and are then pressed together to transfer the image.

BACKGROUND OF THE INVENTION

In image transfer processes which use two-sheet diffusion materials, a negative sheet or a donor sheet is exposed imagewise with a subject, wetted with a developing liquid or an activator and then pressed congruently onto a positive or receiver sheet. During the firm contact between the two sheets, an image-forming substance, for example a silver salt or a dye diffuses out of the imagewise exposed negative sheet into the positive sheet. A positive image is obtained after the sheets have been separated.

Various processes and apparatus are known for carrying out the image transfer process, in which either it is only the negative sheet which is exposed to a developer and the positive sheet is delivered dry through a second channel to the wetted negative sheet for pressing together, or both sheets are passed at the same time, but separately through a developer solution and are only brought together at pressing rollers where they are pressed together. Devices of this type are known, for example from U.S. Pat. No. 4,223,991 or from the publication Research Disclosure (December 1978. P. 32, No. 17,647).

These and other known devices suffer from the disadvantage that it is very difficult to guide the two sheets separately or together through the developer solution so that they are exactly congruent when pressed together by the pressing rollers. Thus, such devices do not allow borderless enlargements. The positive sheet has to be trimmed to the final size of the image.

Therefore, in order to compensate for the fitting inaccuracies caused by the devices, the positive sheets are cut larger in length (about 5 mm) than the appropriate negative sheets and are then trimmed all round after processing. Thus, apart from the additional working expense, a considerable loss of material also results.

Swiss Pat. No. 375,609 discloses a process and an apparatus for the development of reproductions, in which the exposed negative sheet is bonded at one of its edges to the corresponding edge of the positive sheet. The apparatus has a removable or pivotal part, on which the bonded edge is applied outside the apparatus and is guided thereby through the developer to the pressing rollers. In this process, both sheets are wetted with developer liquid.

The process and apparatus are very difficult to manage. The pivotal part is moistened with developer and it wets an area of the positive and negative sheets even outside the apparatus while the two sheets are being positioned on this part, so that the sheets may stick to the part, at least, at the contact points for a longer time to the developer liquid.

Thus, an object of the present invention is to provide a process and an apparatus of the initially mentioned type, with which it is easily possible to wet evenly a positive sheet and an exposed negative sheet with a developing liquid to transfer the image and to exactly guide and press the two sheets together so that the edges of these sheets are exactly congruent.

SUMMARY OF THE INVENTION

Proceeding from a process of the initially mentioned type, this object is achieved for a process in that the positive and negative sheets are joined together flexibly and transversely to the direction of movement by an adhesive strip, and are guided in tandem through the developing liquid to be wetted, after the sheets have been guided through the developing liquid, the rigidity of the photographic material and the flexibility of the bending point of the adhesive strip are used, together with a collecting device for the first-wetted sheet to effect a self-maintained V-shaped folding together of the sheets about the bending point of the adhesive strip, and the two sheets are guided by a deflection device to a pair of pressing rollers with the bending point folded in V-shape in front, are taken up by these rollers and conveyed, pressed together, into a collecting tray.

It was surprising that it was possible, merely by the use of the rigidity of the positive and negative sheets and by the flexibility of the adhesive strip joining these sheets, for the two sheets automatically to fold together along an edge and that it was possible to guide the resulting V-shaped bending point exactly between two pressing rollers, between which the sheets are then pressed one on top of the other, with an exact fit, and for the image to be transferred. Due to the present process, it is now also possible to guide the two sheets in tandem through the developing bath, whereby the layers on the sheets are wetted rapidly in a most effective manner. The evenness of the wetting is further improved in that both sheets are wetted and any wetting irregularities are substantially evened out when the sheets are brought together.

As a result of the tandem arrangement of the sheets, instead of the former superimposed arrangement, simple passage devices may be used for the present process which do not require a dividing tongue at the inlet for the sheets, or a separate guidance through the device or the developer for the two sheets. The front sheet may be introduced easily, because the sheets are automatically joined in an exact superposition later on.

To carry out the present process in an advantageous manner, the positive sheet is introduced first of all into the apparatus, because this sheet can endure a comparatively long residence time in the air without being damaged, whereas the residence time in the air of the negative sheet wetted with developer should be as short as possible and is to be independent of the respective image format.

The present object for an apparatus to carry out the present process, is achieved, in that;

a first pair of transport rollers for taking up and transporting the positive and negative sheets joined together by an adhesive strip transversely to the direction of transport and arranged in tandem, is positioned upstream of a developing tray;

a second pair of transport rollers for taking over and further transporting the wetted sheets is provided downstream of the developing tray;

a collecting device having a stop for receiving, arresting and curving up the sheet which is first introduced is positioned downstream of the second pair of transport rollers, a deflection device for guiding and curving the subsequent second sheet is attached between the second pair of transport rollers and the collecting device, and a third pair of rollers is positioned as a pair of pressing rollers opposite the deflection device so that the V-shaped bending point of the sheets which is produced by the rigidity of the sheets which curve up and by the flexibility of the adhesive strip is delivered to and taken up by the pair of pressing rollers, and the sheets, pressed one on top of the other, are transported into a collecting tray.

It is easily possible to develop two-sheet diffusion materials using this surprisingly simple apparatus. The first sheet, preferably the positive sheet, is positioned by hand between the first pair of rollers to be taken up into the apparatus, is caught up by these rollers, guided through the developer tray, taken up by the second pair of rollers and pushed into the collecting device against a stop. The following negative sheet which is joined to the positive sheet by an adhesive strip located transversely to the direction of movement, curves the positive sheet and itself up, so that the two sheets form a V-shaped bending point along the edge of the adhesive strip, which point is pressed by the deflection device between two pressing rollers and is taken up by these rollers. The pressing rollers press the two sheets firmly together, so that the image may be transferred between the sheets wetted with developer liquid. The joined sheets are simultaneously transported into a discharge channel and from there, they pass into a collecting tray, from which they are removed after a short residence time and are separated from each other. The positive sheet may then be further treated, for example rinsed.

The sheets are preferably wetted in a developing tray, through which they are pushed or drawn. In order to reduce the friction between the sheets and the tray, the tray may be provided with prominences in the direction of movement of the sheets so that only a linear contact takes place between the sheets and the bottom of the tray.

According to one advantageous embodiment, the developing tray may be provided with two superimposed guide devices between the first and second pair of rollers, between which devices the positive and negative sheets are reliably guided through the developer. These guide devices consist of adjacent round rods, but they may also consist of perforated sheets or grids which are constituted such that the developer may flow through and the sheets cannot become congested. However, the sheets may also be guided through the developer or activator bath by further rollers or pairs of rollers, as are conventional in continuous developing machines.

The adaptability of the present apparatus to a plurality of formats is of considerable advantage. The format diversity is achieved in that, on the one hand the positive and negative sheets may be joined together along their longitudinal sides or along their transverse sides and on the other hand, the stop for the sheet which is introduced first may be adjusted in the collecting device and may be adapted to the respective formats. Likewise, the deflection device is arranged so that it may be adjusted in its spacing and angle with respect to the path of the sheets. Whereas in the case of conventional two-sheet processing devices, the smallest format which is to be processed must be greater in the direction of movement than the spacing between the introduction roller and the pressing roller, the transport-effective sheet length is doubled by the bonding together of the two sheets in tandem, so that it is also possible for smaller formats of the individual sheets to be processed.

An improvement in the passage properties of the sheets through the apparatus is achieved by providing all the surfaces which come into contact with the sheets which have already been wetted, for example, the surfaces of the deflection device, the collecting device or the surfaces of the discharge channel, with prominences which project into the path of the sheets, for example with roundedoff bars or burls which extend in the direction of transport, with which the sheets have only a linear contact, and they easily slide over said bars or burls even when, they are wet, without becoming congested.

BRIEF DESCRIPTION OF THE DRAWINGS

One embodiment of the present invention will now be described in more detail in the following with reference to drawings, in which.

DETAILED DESCRIPTION OF THE DRAWINGS

Figure 1:
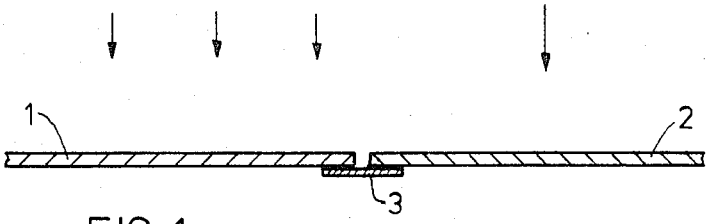
FIG. 1 shows a positive sheet and a negative sheet which are joined by an adhesive strip.

In FIG. 1, a negative sheet 1 is joined to a positive sheet 2 along one edge by an adhesive strip 3. Compared to the sheets 1,2 which are relatively rigid, the adhesive strip 3 is substantially thinner and thus more flexible, so that the sheets 1, 2 may be folded easily one on top of the other about their bonded edge, but are firmly joined together. The negative sheet 1 is exposed imagewise (arrows), for example using an enlarger. The image is observed, after development, on the positive sheet 2 in the direction of the arrow. The sheets are bonded so that their effectively coated surfaces are on one side and the adhesive strip 3 is on the other side.

The negative and positive sheets which are joined together may be produced by cutting lengthwise a web having a negative coating and a web having a positive coating in rolls of an equal width. One roll of negative material and one roll of positive material are adjacently positioned on an apparatus, unwound and, during this operation, one longitudinal edge of the positive material 2 is joined to the adjacent edge of the negative material 1 by an adhesive strip 3, and the two webs are jointly cut into formats transversely to the direction of movement. The joined sheets 1,2 obtained in this manner may be stacked in tandem one upon another and packed as a pair of sheets as shown in FIG. 1.

Figure 1B:
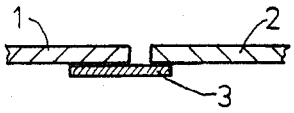
FIGS. 1*b* and 1*c* show particular methods of bonding the sheets.
Figure 1A:
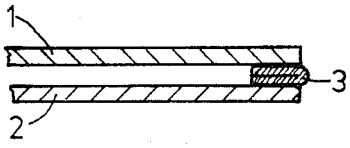
FIG. 1*a* shows the joined sheets during exposure.

Unwieldy packings are produced when this method is used in the case of larger formats. Therefore, it has proved advantageous to fold the sheets 1, 2 one on top of the other, even before packing, so that their coated sides lie outside, and then to pack the pair of sheets in a pile. In the packing, the pair of sheets are positioned such that the layer side of the negative sheet is at the top, as shown in FIG. 1*a*.

For exposure, each pair of sheets may thus be directly removed from the packing with the side to be exposed on the top, and positioned under an enlarger. Conventional enlarging frames may also be used, because the negative and positive sheets are exactly the same size.

In the case of known image transfer processes which use two individual sheets, the layer sides of the sheets are marked by notches on the top right-hand edge. These notches are exposed in the peripheral region of the positive sheet and are disturbing. Therefore, the edges have to be trimmed. In the present process, notches are unnecessary, because the layer sides of the sheets 1,2 are allocated to one another by the adhesive strip 3. The negative sheet 1 which is generally provided with a substantially darker surface may be easily distinguished from the generally white positive sheet 2 during exposure, so that incorrect handling may be corrected at any time.

The negative sheet 1 may be joined to the positive sheet 2 by means of standard plastics adhesive strips or even by paper adhesive strips. The adhesive strip 3 may be applied in the middle on the back of the two sheets 1,2, as shown in FIG. 1. The adhesive strip 3 in FIG. 1*b* is advantageously applied so that only a small part of the strip 3 is bonded to the positive sheet 2 and a larger part is bonded to the negative sheet 1. After the image has been transferred, the positive sheet 2 may be separated from the negative sheet 1 so that no adhesive strip 3 remains on the positive sheet.

Figure 1C:
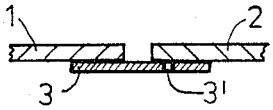

FIG. 1*c* shows an embodiment of the adhesive strip 3, in which the strip is provided with a perforation 3', and the negative sheet 1 and the positive sheet 2 may be separated from one another in a particularly simple manner once the image has been transferred.

Figure 2:
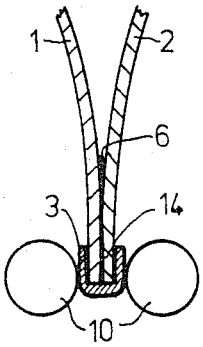
FIG. 2 shows the sheets which are guided together in a V-shape.

FIG. 2 shows the negative sheet 1 and the positive sheet 2 which have been wetted with developer 6 and form a V-shaped bending point 14, being joined by the adhesive strip 3. They are delivered in this condition to a pair of pressing rollers 10 and are engaged by said rollers. In the V-shaped wedge, the developer 6 again coats the complete surface of the sheets 1, 2 as a bead of liquid, due to the pressing procedure, and ensures a further improvement of the wetting procedure.

Figure 3:
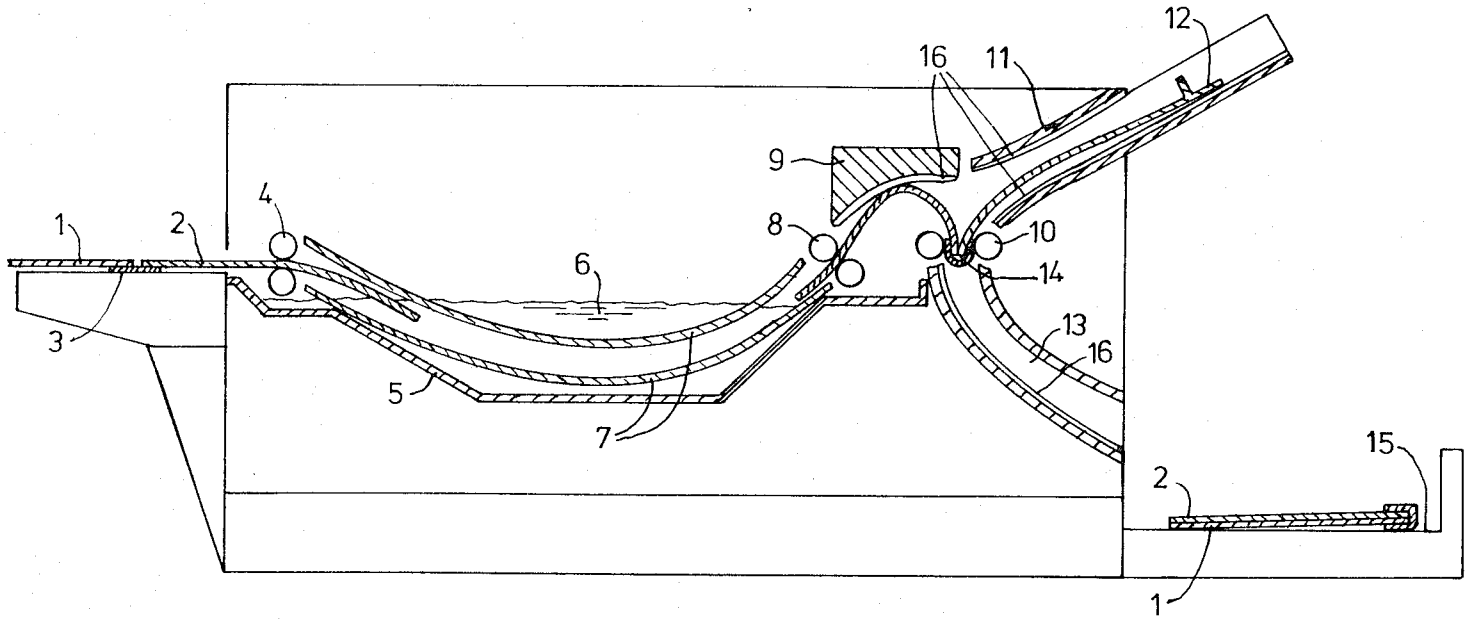
FIG. 3 shows an apparatus for developing the positive and negative sheets according to an image transfer process.

FIG. 3 shows an apparatus for developing the pair of sheets described above, consisting of the negative sheet 1 and the positive sheet 2. This apparatus contains a developing tray 5 which is filled with a developer 6. The developer may be a photographic developer or an activator, for example caustic potash solution or soda lye. The developer tray 5 is inserted in the apparatus such that it may be removed to be cleaned.

If the present apparatus is used for the optimum processing of offset plates or films, the apparatus which is shown may be supplemented by known devices, for example, a developer bath heater with a thermostat to maintain the temperature constant, by a rotating pump to circulate the contents of the bath and for increased use of the developer and hy an additional developer tank (not shown).

If the present apparatus is used for the image-transfer process using two-sheet diffusion materials, the above-mentioned additional devices are unnecessary, because the temperature exerts only a slight influence on the quality of the image, and developing is carried out at normal room temperature of from 18° to 20° C. The activators are consumed only very slowly, so that, depending on the size of the tray, a large to very large number of images may be produced just by filling the tray once.

On the inlet side of the apparatus there is provided a first pair of rollers 4, to which the positive sheet 2 is delivered by hand in order to be developed. On the outlet side of the tray 5, a second pair of rollers 8 is provided which take over the sheet 2 which is the first sheet dipped into the developer 6. These rollers 8 move the sheet 2 on and, in so doing, squeeze out excess developer 6, allowing it to return into the tray 5. The sheets 1, 2 may slide along the bottom of the tray between the pairs of rollers 4, 8 to the second pair of rollers 8 if the bottom of the tray is provided with raised guide rails (not shown) in the direction of movement of the sheets, which rails prevent a surface contact between the sheets 1,2 and the bottom of the tray 5.

FIG. 3 shows a preferred embodiment in which, between the pairs of rollers 4, 8, two guide devices 7 are provided, between which the sheets 1, 2 are guided through the developer 6. The guide devices 7 consist of, for example round rods which are positioned parallel with respect to one another in the direction of movement of the sheets 1, 2 and are joined together as a removable insert. The sheets are guided in a reliable, substantially anti-friction manner between the guide devices 7 from the first pair of rollers 4 to the second pair of rollers 8. The arrangement of the guide devices also allows smaller formats to be developed with the apparatus, the doubled length of said formats being slightly longer than the longest spacing between the pairs of rollers 4, 8 via the guide devices 7. The number of format sizes which may be processed with the present apparatus is thus considerably greater than the number of format sizes which may be processed by known devices.

For example, with an apparatus which has rollers of a width of 31 cm and a spacing between the rollers of 20 cm, all image formats of from 9×12 cm to 30×40 cm may be processed. In the case of the smaller formats, for example 9×12 cm and 13×18 cm, two double sheets may advantageously be introduced into the apparatus at the same time and may be developed at the same time. Formats of 13×18 cm and 24×30 cm may be processed with their longitudinal side at the front as well as with their transverse side at the front. Of course, the apparatus may also be designed with wider rollers for larger formats, or with narrower rollers for smaller formats for amateur photographers.

A collecting device 11 is positioned downstream of the second pair of rollers 8. This collecting device 11 consists of a single flat channel and is provided with a stop 12 which may be adjusted for different formats, and is provided for temporarily receiving the first-wetted positive sheet 2. A deflection device 9 is positioned between the collecting device 11 and the second pair of rollers 8. This device 9 may be adjusted in its spacing and angle with respect to the straight path of the positive sheet 2 between the second pair of rollers 8 and the collecting device 11. The surface of the deflection device 9 facing the sheets is shaped such that once the front edge of the positive sheet 2 meets the stop 12, the sheets 1, 2 which curve up, form a V-shaped bend 14 which is directed towards a pair of pressing rollers 10. As the sheets continue to curve up, the deflection device guides the V-shaped bend 14 towards the gap between the pressing rollers 10, assisted by the negative sheet 1.

The pressing rollers 10 may be driven manually or by an electromotor together with the pairs of rollers 4 and 8 and at the same speed. The rollers may advantageously be produced from rubber or a flexible plastics, material, or they may be coated with a material of this type to ensure that the sheets are transported evenly and without slipping. Of the pairs of rollers 4, 8 and 10, one roller may be driven in each case, and the second roller may be pressed resiliently against the driven roller (not shown).

In order to improve the sliding properties of the wet sheets in the apparatus, the surfaces which come into contact with the sheets, such as the surfaces of the deflection device 9, the collecting channel 11 and the discharge channel 13 may be provided with slide rails 16 in the direction of movement of the sheets. The slide rails 16 may be prominences which project into the path of the sheets, such as bars or burls.

A discharge channel 13 is positioned under the pair of pressing rollers 10. Into this channel 13 the pair of pressing rollers 10 conveys the sheets 1, 2 which are guided and pressed together in an exact manner. At the end of the channel 13, there is a collecting tray 15 into the which the developed sheets 1, 2 fall and, after the image has been transferred, may be removed in order to be separated. The positive sheet 2 is separated for further processing, and rinsed and dried.

The use of the apparatus is extremely simple. The negative and positive sheets 1, 2 which are folded together are removed from the packing, the negative sheet is exposed, the sheets 1, 2 are unfolded and, with the positive sheet 2 at the front, are guided into the slit of the apparatus, in which the first transport rollers 4 engage the sheet 2 and draw the two sheets 1, 2 into the apparatus. The two sheets 1,2 leave the apparatus, folded together, through the discharge channel 13, after automatic development and image transfer, and are positioned in the collecting tray 15. The necessary immersion period of the sheets in the developer amounts to a few seconds, for example 10 seconds, so that the developed double sheet of negative and positive sheets 1, 2 is discharged from the apparatus after 20 to 30 seconds, depending on the size of the format. While one pair of sheets 1, 2 is drawn into the apparatus, the following pair of sheets 1, 2 is exposed and introduced into the apparatus directly after the first pair of sheets 1, 2 has been drawn in. As already shown above, two pairs of sheets 1, 2 may be developed next to one another at the same time in the case of smaller formats.

In the apparatus, the first sheet, the positive sheet 2 is pushed into the developer 6 by the first pair of rollers 4 between the guide devices 7. It passes for about 10 seconds through the developer 6 and is taken up by the second pair of rollers 8 which then draw the remaining part of the sheets 1, 2 through the developer 6, and push the first positive sheet 2 into the collecting device 11, while the negative sheet 1 is still conveyed by the second pair of rollers 8. The first positive sheet 2 reaches the stop 12 and under the pressure exerted by the second sheet 1, starts to bend due to its rigidity. Once the sheet 2 reaches the top surface of the collecting device 11 and the deflection device 9, the joining point of the sheets 1, 2 bends along the flexible adhesive strip 3 and forms a V-shaped bending point 14, the tip of which points towards the pair of pressing rollers 10. As the negative sheet 1 is moved on by the second pair of rollers 8, the surface of the sheet 1 passes in a curved condition along the deflection device 9 which guides the V-shaped bending point 14 directly into the wedge between the pressing rollers 10. These rollers 10 catch the bending point 14 and fold and press the two sheets together and convey them out of the apparatus.

The apparatus is shown in FIG. 3 such that the sheets 1, 2 which are folded together are discharged from below. By interchanging the pair of pressing rollers 10 with the deflection device 9, the pair of sheets 1, 2 may also be guided upwards through a channel. Likewise, the wetting of the sheets 1, 2 with developer liquid in a tray, which operation is shown in FIG. 3, may be replaced by a spray wetting operation, in which case the two sheets are sprayed with developer from one side through nozzles. The developer may also be applied to the surface of the sheets 1, 2 by rollers, so that only the layer sides of the sheets are wetted.

The process and apparatus which have been described may be used in the offset technique for the production of correction prints, cover copies, positives, negatives and intermediate layers. Likewise, the process and the apparatus may be used for the production of colour images according to the two-sheet diffusion process, for example, in order to produce a colour positive image from a transparency by means of an enlarged negative sheet.

In addition to exposing the negative sheet using an enlarger as mentioned above, the negative sheet may also be exposed in a cassette camera or in a reproduction camera, or in contact with the original.

Since the negative and positive sheets of the pair of sheets are equal in size, the pair of sheets may also be introduced into cassettes of a camera for exposure, and then delivered to the apparatus after exposure.

We claim:

1. A process for the development of photographic two-sheet diffusion materials, in which process a positive sheet and an exposed negative sheet are passed through a developing liquid and are then pressed together in order to transfer the image, characterised in that the positive sheet and the negative sheet are joined together flexibly and transversely to the direction of movement by an adhesive strip and are passed in tandem through the developing liquid for wetting, after the sheets have been guided through the developing liquid, the rigidity of the photographic material and the flexibility of the adhesive strip bending point are used together with a collecting device for the first-wetted sheet to produce a self maintaining V-shaped folding together of the sheets about the adhesive strip being point, and the two sheets are guided by a deflection device to a pair of pressing rollers, with the bending point, folded in V-shape, at the front, are taken up and pressed together by this pair of pressing rollers and are conveyed into a collecting tray.

2. A process according to claim 1, characterised in that the positive image-receiving sheet is the first to be introduced into the apparatus.

* * * * *